US006681697B2

(12) United States Patent
Möhringer et al.

(10) Patent No.: US 6,681,697 B2
(45) Date of Patent: Jan. 27, 2004

(54) DEVICE FOR ALIGNING SHEETS IN A FEEDER OF A SHEET-PROCESSING MACHINE, ESPECIALLY A PRINTING PRESS

(75) Inventors: Markus Möhringer, Weinheim (DE); Jochen Renner, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/324,824

(22) Filed: Dec. 20, 2002

(65) Prior Publication Data

US 2003/0116046 A1 Jun. 26, 2003

(30) Foreign Application Priority Data

Dec. 20, 2001 (DE) ..... 101 62 629

(51) Int. Cl.[7] ..... B41F 13/24

(52) U.S. Cl. ..... 101/232; 101/231; 101/480; 271/245; 271/246; 271/247; 271/253; 271/141; 271/226

(58) Field of Search ..... 101/480, 231, 101/232; 271/245, 246, 247, 253, 141, 226

(56) References Cited

U.S. PATENT DOCUMENTS

| | | | | |
|---|---|---|---|---|
| 4,402,266 A | | 9/1983 | Sugiyama | |
| 5,297,789 A | * | 3/1994 | Filsinger et al. | 271/245 |
| 5,322,012 A | * | 6/1994 | Gartner et al. | 101/232 |
| 5,390,908 A | * | 2/1995 | Luxem | 271/247 |
| 5,496,023 A | | 3/1996 | Becker et al. | |
| 5,761,998 A | | 6/1998 | Fricke et al. | |
| 6,264,196 B1 | * | 7/2001 | Lotsch | 271/228 |

FOREIGN PATENT DOCUMENTS

| | | |
|---|---|---|
| DE | 800 126 | 9/1950 |
| DE | 32 15 804 A1 | 11/1982 |
| DE | 42 43 585 C2 | 6/1994 |
| DE | 43 06 238 A1 | 9/1994 |
| DE | 196 00 793 C2 | 7/1997 |

* cited by examiner

*Primary Examiner*—Andrew H. Hirshfeld
*Assistant Examiner*—Andrea H. Evans
(74) *Attorney, Agent, or Firm*—Laurence A. Greenberg; Werner H. Stemer; Ralph E. Locher

(57) ABSTRACT

A device for aligning sheets on a feeder of a sheet-processing machine includes a plurality of pivotably disposed front lays and a plurality of pivotably disposed top lays, the top lays being vertically adjustable. The front lays and the top lays are respectively assigned to and combined with one another and have a common pivoting drive. A push rod vertically adjusts the top lays, and a wedge-like slide actuates the push rod.

7 Claims, 3 Drawing Sheets

DEVICE FOR ALIGNING SHEETS IN A FEEDER OF A SHEET-PROCESSING MACHINE, ESPECIALLY A PRINTING PRESS

BACKGROUND OF THE INVENTION

Field of the Invention

The invention relates to a device for aligning sheets in a feeder of a sheet-processing machine, especially a printing press.

In order to achieve good feed register with thin printing materials (lightweight grammages), it is necessary to hold down the leading edge of the respective sheet in the vicinity of the front lays. For that purpose, top lays are provided which, in order to be able to fulfill the aforementioned objective, must be adaptable, by vertical adjustment, to the varying grammages of the sheets to be processed. Otherwise, in particular for lightweight grammages, register problems may occur, for example so-called ghosting.

A device of the type referred to in the introduction hereto has been disclosed in German Patent DE 196 00 793 C2, corresponding to U.S. Pat. No. 5,761,998. In that heretofore-known construction, separate front lays and separate top lays are provided, which are respectively pivotable and vertically adjustable, independently of one another. The gear mechanisms or transmissions required for that purpose are accordingly complicated, and therefore expensive.

SUMMARY OF THE INVENTION

It is accordingly an object of the invention to provide a device for aligning sheets on a feeder of a sheet-processing machine, especially a printing press, which overcomes the hereinafore-mentioned disadvantages of the heretofore-known devices of this general type and in which, with a tolerable technical and financial expenditure, the feed register is optimized, especially for the purpose of avoiding undesired, feeder-induced ghosting with lightweight grammages.

With the foregoing and other objects in view, there is provided, in accordance with the invention, a device for aligning sheets on a feeder of a sheet-processing machine. The device includes a plurality of pivotably disposed front lays and a plurality of pivotably disposed top lays. The top lays are vertically adjustable. The respective front lays and the respective top lays are assigned to and combined with one another and have a common pivoting drive, a push rod for vertically adjusting the top lays, and a wedge-like slide for actuating the push rod.

In accordance with another feature of the invention, the push rod extends at least approximately vertically and through an upper end thereof engages via a screw connection with the top lays. The push rod, through a lower end thereof, is operatively connected via a sliding piece to a wedge-like slide for at least approximately horizontally displacing the slide.

In accordance with a further feature of the invention, the lower end of the push rod is anchored in a recess formed in the sliding piece, for firmly connecting the push rod to the sliding piece.

In accordance with an added feature of the invention, the sheet-aligning device further includes a motor-actuatable spindle drive. The wedge-like slide is connected to the spindle drive via an at least approximately horizontally extending rod drive.

In accordance with an additional feature of the invention, the spindle drive includes a spindle rotatively actuatable by a motor and a gear transmission. The spindle is concentrically disposed within a spindle nut and operatively connected thereto via a screw thread. The rod drive is disposed coaxially with the spindle and actuatable thereby via an axial bearing.

In accordance with yet another feature of the invention, the sheet-aligning device further includes a front lay shaft connected to the front lays and serving for pivoting the front lays. The spindle nut is axially and radially mounted on the front lay shaft, and a torque support is provided for securing the spindle nut against rotation.

In accordance with a concomitant feature of the invention, the sheet-aligning device further includes a prestressed compression spring operatively supported at one end thereof on the push rod and, at the other end thereof, on the front lay shaft, for restoring the push rod and the combination of the respective front and top lays.

The invention advantageously makes possible combined front and top lays and, nevertheless, also permits vertical adjustability of the top lays. Heretofore, when a combination of the front and top lays was formed, which is a construction that is desirable from structural and drive aspects, vertical adjustment was not possible.

According to a preferred embodiment of the invention, the push rod disposed vertically or nearly vertically, i.e., at least approximately vertically, engages at the upper end thereof with the top lay via a screw connection and, at the lower end thereof, is operatively connected via a sliding piece to a wedge-like slide that is displaceable horizontally or substantially horizontally, i.e., at least approximately horizontally. In this case, the sliding piece should be firmly connected to the push rod by anchoring the lower end of the push rod in a recess formed in the sliding piece.

In order to effect the actuation of the wedge-like slide according to the invention with less expenditure in technical and financial terms, while at the same time being effective and reliable, an advantageous development of the invention proposes that the wedge-like slide be connected to a spindle drive which is actuatable by a motor via a rod drive that is disposed horizontally or nearly horizontally, i.e., at least approximately horizontally.

Other features which are considered as characteristic for the invention are set forth in the appended claims.

Although the invention is illustrated and described herein as embodied in a device for aligning sheets on a feeder of a sheet-processing machine, especially a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
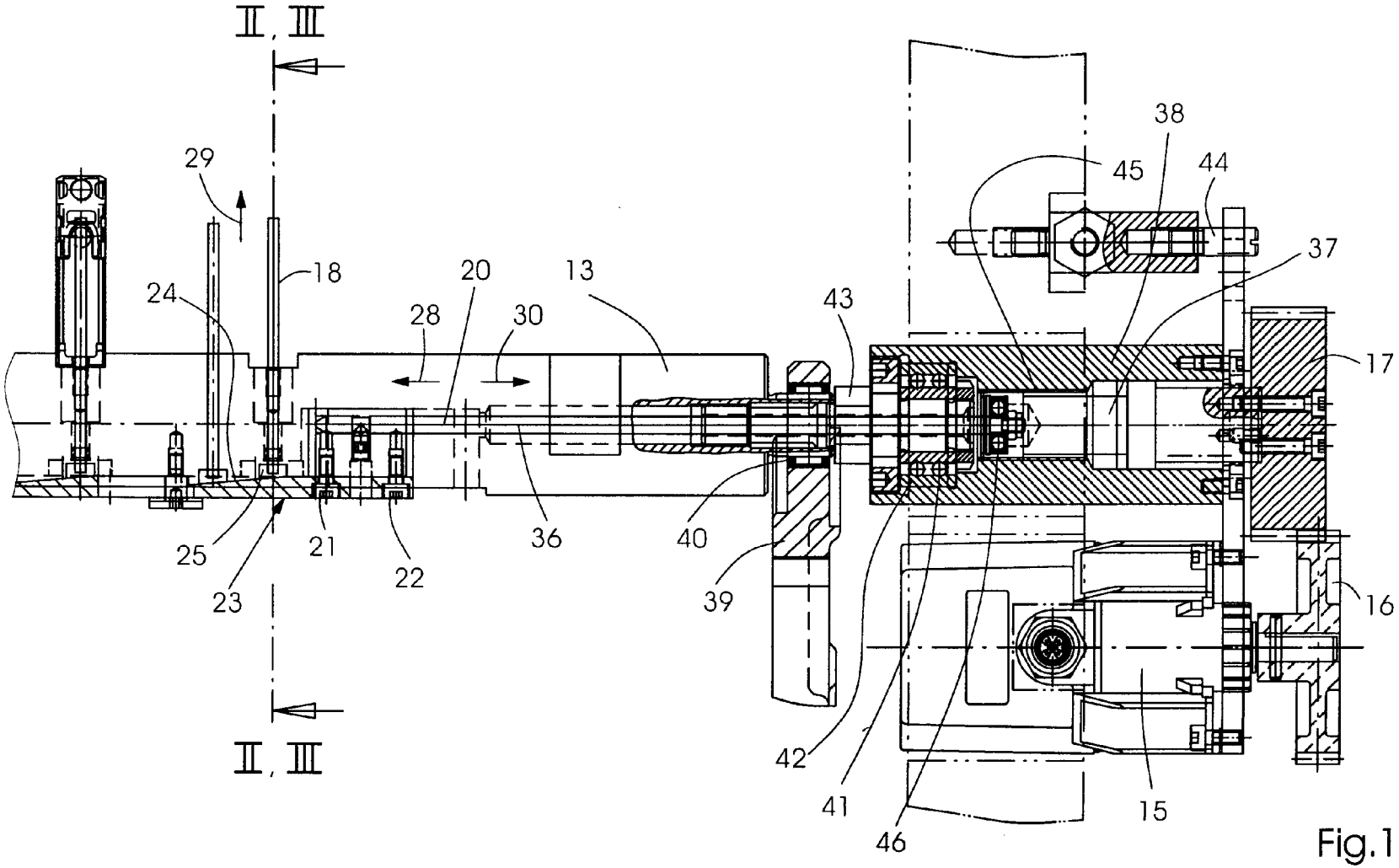
FIG. 1 is a fragmentary, diagrammatic, sectional view of a feeder region of a sheet-fed printing press, as viewed in a conveying direction of sheets.
Figure 2:
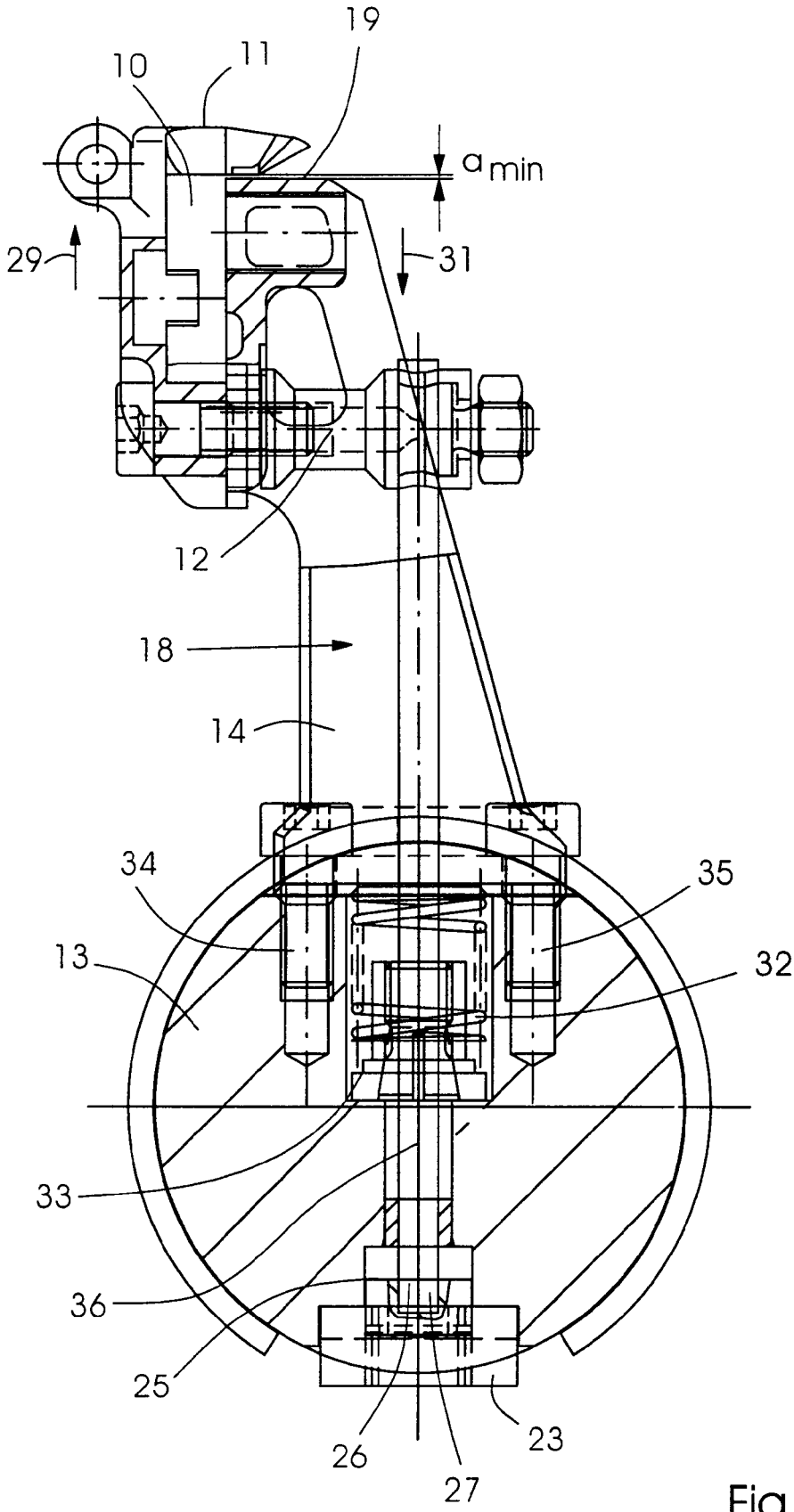
FIG. 2 is an enlarged, sectional view of FIG. 1, taken along a line II—II of FIG. 1, in the direction of the arrows.
Figure 3:
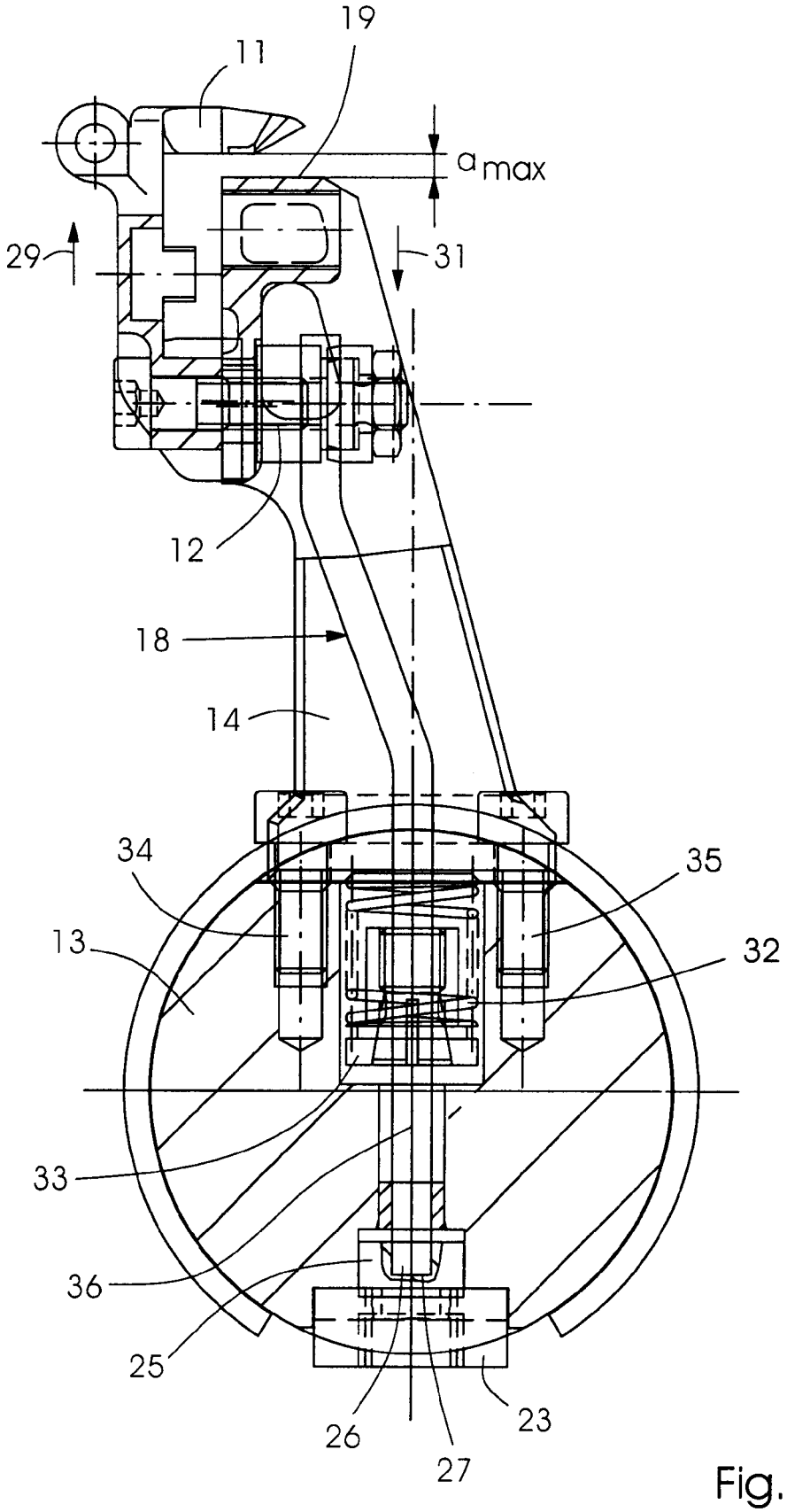
FIG. 3 is an enlarged, sectional view of FIG. 1 similar to that of FIG. 2, which is taken along a line III—III of FIG. 1, in the direction of the arrows, with the front lay being shown vertically adjusted and the top lay having been omitted.

Referring now to the figures of the drawings in detail and first, particularly, to FIGS. 1 and 2 thereof, there is seen a front lay 10 and a top lay 11 of a feeder of a sheet-fed printing press. The front lay 10 and the top lay 11 are combined by a screwed joint 12 into a structural unit which is pivotable via a supporting part 14 by a front lay shaft 13. As is shown in FIGS. 2 and 3, the supporting part 14 is screwed to the front lay shaft 13 by two bolts 34 and 35, so that rotation of the front lay shaft 13 about the longitudinal axis 36 thereof simultaneously effects a corresponding pivoting movement of the supporting part 14, with the front and top lays 10 and 11 fixed thereto. The front lay shaft 13 is actuated by a motor in a conventional manner which is therefore not otherwise specifically shown. The front lay shaft 13 is mounted with rolling contact at least at two points in a printing press housing 39. A roller bearing in this regard is shown in FIG. 1 and is identified by reference numeral 40.

As is apparent, in particular, from FIGS. 2 and 3, a vertically oriented push rod 18 acts with an upper end thereof on the screwed joint 12. The push rod 18 serves for vertically adjusting the combination of the front lay 10 and the top lay 11 with respect to the supporting part 14 and the front lay shaft 13 connected to the latter. A vertical distance a between a surface 19 of the supporting part 14 and the top lay 11 is represented FIGS. 2 and 3. The distance a is varied depending upon the grammage of the non-illustrated sheets to be processed. For example, for lightweight grammages, a correspondingly small vertical spacing akin of the top lay 11 in FIG. 2 is to be selected. By contrast, in the case of heavier grammages, a higher position of the front lay 11 is to be preferred as is seen in FIG. 3, which results in a correspondingly greater vertical spacing $a_{max}$.

As is illustrated in particular by FIG. 1, a horizontally oriented rod drive 20 is disposed so that it is movable in longitudinal direction in the interior of the front lay shaft 13 and concentrically therewith. A free front end of the rod drive 20 is connected by bolts 21 and 22 to a wedge-like slide 23. The wedge-like slide 23 has an operating surface 24 which extends obliquely and by virtue of which it is provided with the wedge shape thereof. The wedge-like slide 23 and the operating surface 24 thereof are respectively operatively connected to a sliding piece 25 which is fixed to the lower end of the push rod 18. For this purpose, the lower end 26 of the push-rod engages in a recess 27 formed in the sliding piece 25 and is thereby anchored to the latter, as is seen in FIGS. 2 and 3.

Due to a displacement of the rod drive 20 and, therefore, of the wedge-like slide 23 in the direction of an arrow 28, the push rod 18 and, therefore, also the top lay 11, including the front lay 10 connected to the latter (as seen in FIG. 2) is adjusted in the direction of an arrow 29, i.e., vertically upwardly, via the oblique surface 24 of the wedge-like slide 23 cooperating with the sliding piece 25. If the rod drive 20 and the wedge-like slide 23 are moved in the direction of an arrow 30 (seen in FIG. 1), the push rod 18 and the combination of the front lay 10 and the top lay 11 are reset (in a direction of an arrow 31) into the initial position that can be seen from FIG. 2. The restoring force required for this purpose is applied by a prestressed compression spring 32 (see FIGS. 2 and 3) which is supported at the top thereof on the supporting part 14, and at the bottom thereof on a disk 33 firmly connected to the push rod 18.

In order to operate the rod drive 20, a spindle drive disposed coaxially with the front lay shaft 13 is provided, and includes a spindle 37 and a spindle nut 38 enclosing the latter concentrically. The spindle nut 38 is mounted on the front lay shaft 13 by two radial ball bearings 41 and 42 and an axial ball bearing 43 and secured against rotation by a torque support 44. A threaded connection 45 is provided between the spindle 37 and the spindle nut 38. At the free end of the spindle 37 (on the side of the rod drive 20), the spindle 37 is mounted on the rod drive 20 by a ball bearing 46. At the same time, the ball bearing 46 produces a Formlocking connection in the axial direction 28, 30 between the spindle 37 and the rod drive 20. In this regard, it is noted that a form-locking connection is one which connects two elements together due to the shape of the elements themselves, as opposed to a forcelocking connection, which locks the elements together by force external to the elements. The spindle 37 can be set into rotation by an electric motor 15 via a gear mechanism or transmission 16, 17. Because of the threaded connection 45 to the spindle nut 38, in this case, the spindle 37 is simultaneously moved in the direction of arrow 28 and 30, respectively, and consequently actuates the rod drive 20 accordingly via the axial bearing 46. Due to the connection 21, 22 between the rod drive 20 and the wedge-like slide 23, the wedge slide 23 is thereby accordingly actuated and, as explained above hereinbefore, adjusts the height of the front and the top lays 10 and 11 via the sliding piece 25 and the push rod 18.

We claim:

1. A device for aligning sheets on a feeder of a sheet-processing machine, the device comprising:

at least one pivotably disposed front lay; and at least one pivotably disposed and vertically adjustable top lay;

said at least one front lay being assigned to and combined with said at least one top lay;

a common pivoting drive for said combined front lay and top lay;

a push rod for vertically adjusting said at least one top lay; and a wedge-like slide for actuating said push rod.

2. The sheet-aligning device according to claim 1, further comprising a screw connection, and a sliding piece, said push rod extending at least approximately vertically and having an upper end engaging through said screw connection with said top lay, and said push rod having a lower end operatively connected through said sliding piece to said wedge-like slide for at least approximately horizontally displacing said wedge-like slide.

3. The sheet-aligning device according to claim 2, wherein said lower end of said push rod is anchored in a recess formed in said sliding piece, for firmly connecting said push rod to said sliding piece.

4. The sheet-aligning device according to claim 1, further comprising a motor-actuatable spindle drive, and an at least approximately horizontally extending rod drive connecting said wedge-like slide to said spindle drive.

5. The sheet-aligning device according to claim 4, further comprising a motor, a gear transmission, and an axial bearing, said spindle drive having a spindle and a spindle nut, said spindle to be actuated into rotation by said motor and said gear transmission, and said spindle being concentrically disposed within said spindle nut and operatively connected to said spindle nut via a screw thread, said rod drive being disposed coaxially with said spindle for actuation by said spindle via said axial bearing.

6. The sheet-aligning device according to claim 5, further comprising a front lay shaft connected to said front lay for pivoting said front lay, said spindle nut being axially and radially mounted on said front lay shaft, and a torque support for securing said spindle nut against rotation.

7. The sheet-aligning device according to claim 1, further comprising a prestressed compression spring for restoring said push rod and said combination of said front and top lays, said compression spring having one end operatively supported on said push rod and another end operatively supported on said front lay shaft.

* * * * *